US006984115B1

(12) United States Patent
Tarng et al.

(10) Patent No.: US 6,984,115 B1
(45) Date of Patent: Jan. 10, 2006

(54) AXIAL SEALING STRUCTURE OF SCROLL COMPRESSOR

(75) Inventors: Guang-Der Tarng, Shi-Chih (TW); Michael Wang, Shi-Chih (TW)

(73) Assignee: Chyn Tec. International Co., Ltd., Taipei (TW)

( * ) Notice: Subject to any disclaimer, the term of this patent is extended or adjusted under 35 U.S.C. 154(b) by 0 days.

(21) Appl. No.: 10/978,580

(22) Filed: Nov. 2, 2004

(51) Int. Cl.
*F04C 18/00* (2006.01)

(52) U.S. Cl. ..... 418/55.4; 418/55.1; 418/55.5; 418/57; 277/348; 277/422

(58) Field of Classification Search ..... 418/55.4, 418/55.5, 57, 55.1; 277/348, 422, 579, 585
See application file for complete search history.

(56) References Cited

U.S. PATENT DOCUMENTS 5,156,539 A * 10/1992 Anderson et al. ..... 418/55.4
5,257,920 A * 11/1993 Takeda ..... 418/55.5
RE35,216 E 4/1996 Anderson et al.
5,545,019 A * 8/1996 Beck et al. ..... 418/55.1
5,547,355 A * 8/1996 Watanabe et al. ..... 418/55.5
5,562,435 A * 10/1996 Cho et al. ..... 418/55.5
5,897,306 A * 4/1999 Beck ..... 418/55.4

FOREIGN PATENT DOCUMENTS

JP 05149269 A * 6/1993
JP 06042470 A * 2/1994

* cited by examiner

*Primary Examiner*—Theresa Trieu

(57) ABSTRACT

An axial sealing mechanism of a scroll compressor includes a housing, a scroll device, and a floating seal member with a recess portion and a central channel. The housing includes a first shell and a second shell. The first shell has a receiving chamber. A partition is disposed inside the receiving chamber. The scroll device includes a fixed scroll and an orbiting scroll. A plurality of compression pockets is formed between the fixed scroll and the orbiting scroll. The fixed scroll has a protruding portion with a plurality of orifices. The recess portion of the floating seal member receives the protruding portion of the fixed scroll. Seal elements are respectively secured to the floating seal member and the fixed scroll. An intermediate pressure room is thereby formed between the float seal element and the fixed scroll.

11 Claims, 4 Drawing Sheets

AXIAL SEALING STRUCTURE OF SCROLL COMPRESSOR

BACKGROUND OF THE INVENTION

The present invention relates in general to an axial sealing structure of a scroll compressor, and more particularly, to an axial sealing structure of a scroll compressor with a floating seal member, capable of both simplifying and reducing the difficulty of the assembling procedure of the scroll compressor. Thereby, a scroll compressor has a better product quality and a lower production cost.

A typical scroll compressor includes a fixed scroll and an orbiting scroll. The orbiting scroll revolves about the fixed scroll. The fixed scroll and the orbiting scroll each has a spiral wrap inter-fitting each other to allow working fluid entering a compression pocket through a suction port. The continuous revolutions of the orbiting scroll compress the working fluid until the working fluid is discharged from an inner discharge port of the fixed scroll. During the compression process the volume of the working fluid is reduced while the pressure thereof is increased. Axial force, radial force and tangential force appear in the compression process. The axial force tends to cause axial separation of these two scroll members. The radial and tangential forces generate biasing torques. The axial, radial and tangential forces cause leakage from the end panels or the side surfaces of the wraps. How to enhance the volume efficiency of the compressor has thus become an important topic in this field.

A conventional axial sealing structure of a scroll compressor, for example, U.S. RE 35216, comprises a fixed scroll member with an annular cavity formed on the back thereof inside which an annular floating seal member is disposed. The floating seal member has at least one outer lip seal attached the outer wall of the annular cavity and at least one inner lip seal attached the inner wall of the annular cavity. A working fluid under an intermediate pressure flows from a compression pocket into the annular cavity through an orifice and builds an intermediate pressure inside the annular cavity. The fixed scroll member is thus axially biased against an orbiting scroll member by the forces created by discharge pressure acting on the central portion of the fixed scroll member and those created by intermediate pressure acting on the bottom of the cavity. The axial sealing is thereby achieved.

However, there is a problem still existing in the conventional axial sealing structure. Because the floating seal member is inserted downward into the annular cavity on the back of the fixed scroll member, both the outer lip seal and the inner lip seal secured to the floating seal member are flipped upward. But, the outer lip seal is to isolate the intermediate pressure working fluid from the low pressure working fluid. The outer lip seal has to be disposed downward to have its isolating function. Therefore, after the installation of the floating seal member, the outer lip seal has to be further reoriented downward. To simplify the assembling procedure for increasing the production speed, it is therefore necessary for manufacturers to design a special tool. The special tool is able to hold the outer lip seal downward and to deform the outer lip seal for decreasing the circumference of the outer lip seal. The special tool holding the outer lip seal and the floating seal member are simultaneously inserted into the annular cavity. The special tool is then withdrawn from the annular cavity. In summary, although the conventional art can produce a scroll compressor with a floating seal member, the manufacture procedure thereof is tedious and complicated. The conventional art has to consume a longer labor hours to produce a scroll compressor with a floating seal. The fabrication cost of the conventional art is inevitably high.

BRIEF SUMMARY OF THE INVENTION

The present invention provides an axial sealing structure of a scroll compressor. Two seal elements are respectively secured to a floating seal member and a fixed scroll. The present invention is capable of both simplifying and reducing the difficulty of the assembling procedure of the scroll compressor. A scroll compressor utilizing the present invention has a better product quality and a lower production cost.

The axial sealing structure of a scroll compressor of the present invention has the floating seal member disposed between a partition and the top of the fixed scroll. An intermediate pressure room is formed between the floating seal member and the fixed scroll to force the fixed scroll to closely attach an orbiting scroll, so as to enhance the volume efficiency of the compressor.

The axial sealing structure of a scroll compressor of the present invention guides the intermediate pressure working fluid into the intermediate pressure room to force the fixed scroll to move downward such that the axial force and biasing torque applied to the fixed scroll during compression are overcome. The lifetime of the scroll compressor is effectively extended.

According to the present invention, the axial sealing mechanism of the scroll compressor comprises a housing, a scroll device, and a floating seal member with a recess portion and a central channel. The housing includes a first shell and a second shell. The first shell has a receiving chamber. A partition is disposed inside the receiving chamber. The scroll device includes a fixed scroll and an orbiting scroll. A plurality of compression pockets is formed between the fixed scroll and the orbiting scroll. The fixed scroll has a protruding portion with a plurality of orifices. The recess portion of the floating seal member receives the protruding portion of the fixed scroll. Seal elements are respectively secured to the floating seal member and the fixed scroll. An intermediate pressure room is thereby formed between the float seal element and the fixed scroll.

The objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
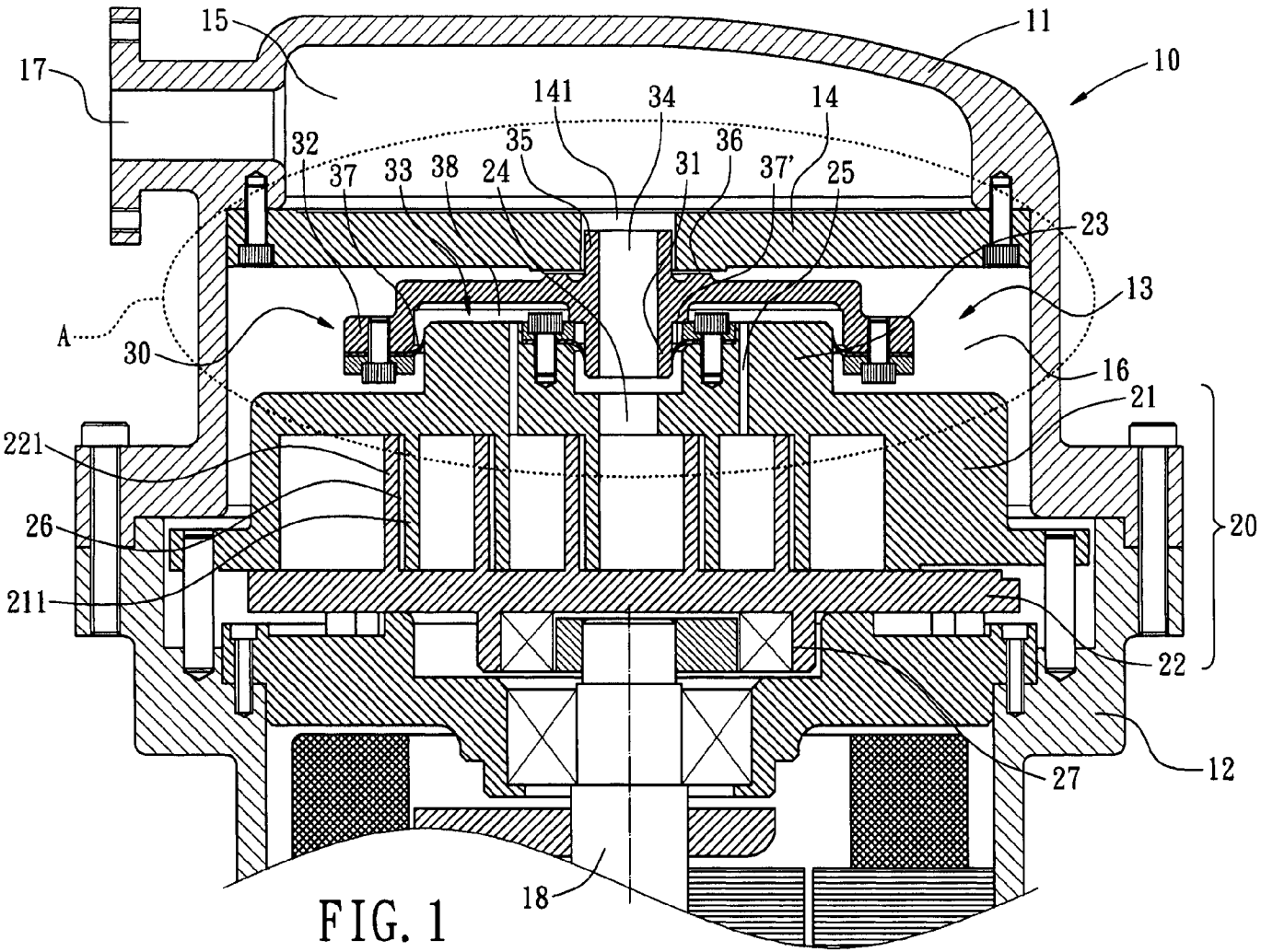
FIG. 1 is a partial cross sectional view of a scroll compressor utilizing a first embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
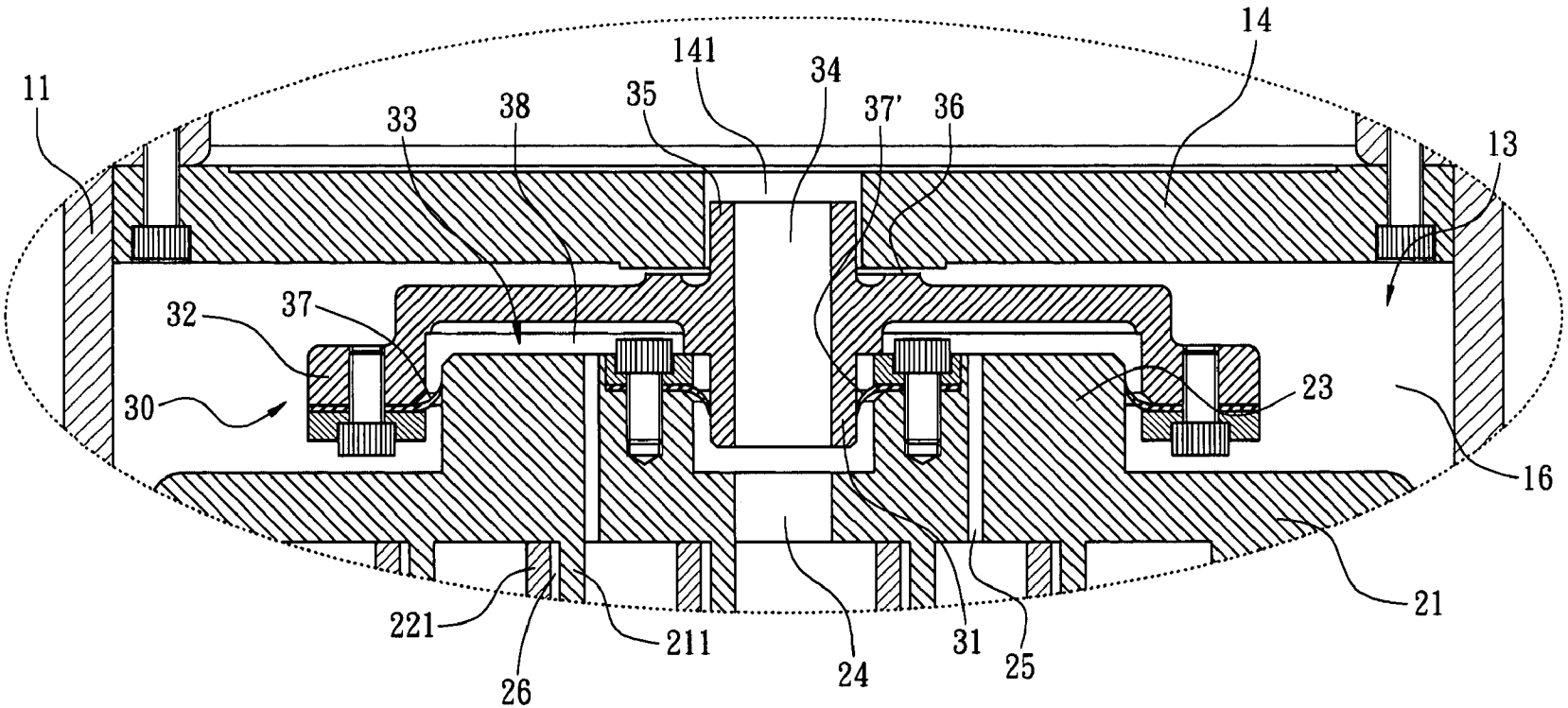
FIG. 2 is an enlarged view of the portion A of FIG. 1.

Referring to FIG. 1 and FIG. 2, an axial sealing structure of a scroll compressor in accordance with the present invention includes a housing 10, a scroll device 20, and a floating seal member 30.

The housing 10 comprises a first shell 11 and a second shell 12. Both the first shell 11 and the second shell 12 have a hollow cavity formed therein. The first shell 11 is secured to the top of the second shell 12 by means of a plurality of fastening members, or by other methods such as a welding or a soldering process. The hollow cavity of the first shell 11 defines a receiving chamber 13. Inside the receiving chamber 13 a partition 14 is installed to separate the inner space of the housing 10 into a high-pressure zone 15 and a low-pressure zone 16. The partition 14 is preferably a circular plate with a circular opening 141 bored in the middle thereof. The circular opening 141 is the inlet of the high-pressure zone 15. The high-pressure zone 15 further connects to a gas outlet 17 formed at one side of the first shell 11. In addition, the second shell 12 has a working fluid inlet (not shown in the figures) bored at one side thereof. The second shell 12 further comprises an electric motor, a transmission mechanism, and other supporting elements installed inside the hollow cavity thereof. The electric motor has a transmission shaft 18 extending from the center thereof.

The scroll device 20 includes a fixed scroll 21 and an orbiting scroll 22. The fixed scroll 21 has a spiral wrap 211 formed at the bottom thereof and a protruding portion 23 formed in the middle thereof. The protruding portion 23 comprises a discharge passageway 24 at the center thereof. The discharge passageway 24 is constituted by two adjoining circular holes with different diameters. The diameter of the lower circular hole is smaller than that of the upper circular hole. A plurality of orifices 25 is bored through the protruding portion 23 at suitable places. Similarly, the orbiting scroll 22 has a spiral wrap 221 formed on the top thereof, which inter-fits the spiral wrap 211 of the fixed scroll 21. A plurality of compression pockets 26 is thereby formed between the spiral wraps 211, 221. The orbiting scroll 22 further comprises a shaft hole 27 formed at the bottom thereof. The shaft hole 27 is used to install a bearing and an eccentric device for connecting the transmission shaft 18 to the orbiting scroll 22.

The floating seal member 30 is disposed between the partition 14 and the fixed scroll 20. The floating seal member comprises an inner ring 31, an outer ring 32, which are located at the bottom thereof, a top barrel 35, and an annular contact surface 36, which are located at the top thereof. The top barrel 35 protrudes into the circular opening 141 of the partition 14. The inner ring 31 extends into the discharge passageway 24 of the fixed scroll 21. The interior spaces of the inner ring 31 and the top barrel 35 constitute a central channel 34, which is able to connect the discharge passageway 24 to the circular opening 141 of the partition 14. The inner ring 31 and the outer ring 32 define a recess portion 33, which is able to receive the protruding portion 23 of the fixed scroll 21. The contact surface 36 tightly engages the bottom of partition 14 in order to prevent the high-pressure working fluid of the high-pressure zone 15 from leakage during compression. The narrow width of the contact surface 36 ensures that the contact surface 36 is under a sufficient pressure to firmly press against the bottom of the partition 14 during compression.

Further, at least a first seal element 37 is disposed between the inner periphery of the outer ring 32 of the floating seal member 30 and the outer wall of the protruding portion 23 of the fixed scroll 21. Similarly, at least a second seal element is disposed between the exterior periphery of the inner ring 31 and the inner wall of the discharge passageway 24 of the fixed scroll 21. The sealing elements, in preferred embodiments, comprise a lip seal. The lip seal, however, may be substituted with other devices, which perform essentially the same function. These other devices may include, but not limited to, an o-ring gasket, a u-shaped sealing ring, a mechanical seal. In preferred embodiments, the exterior portion of the first seal element 37 is secured to the bottom of the outer ring 32 of the floating seal member 30 by means of a fixing ring and a plurality of screws. The interior portion of the first seal element 37 is wider than a gap between the floating seal member 30 and the protruding portion 23 of the fixed scroll 21. The interior portion of the first seal element 37 installed is therefore under a resilient force and presses against the outer wall of the protruding portion 23. Similarly, the exterior portion of the second seal element is secured to the end surface of the protruding portion 23 of the fixed scroll 21 by means of a fixing ring and a plurality of screws. The interior portion of the second element, under a resilient force, presses against the periphery of the inner ring 31. Furthermore, the orifice 25, which is bored through the protruding portion 23, connects the compression pockets 26 to the recess portion 33, and allows working fluid under an intermediate pressure to flow into the recess portion 33. Because the first seal element 37 isolates the recess portion 33 from the low-pressure zone 16 and the second seal element isolate the recess portion 33 from the higher discharge pressure, an intermediate pressure room 38 is thereby formed during compression, between the floating sealing member 30 and the protruding portion 23 of the fixed scroll 21.

To assemble a scroll compressor utilizing the present invention, the first seal element 37 and the second seal element are respectively secured to the outer ring 32 and the end surface of the protruding portion 23 of the fixed scroll 21. Further, the floating seal member 30 is installed onto the top of the fixed scroll 21. Because the first seal element 37 is fixed to the floating seal member 30, the downward movement of the first seal element 37 relative to the fixed scroll 21 during the installation of the floating seal member 30 will bend the interior portion of the first seal element 37 upward. Similarly, because the second seal element is fixed to the protruding portion 23 of the fixed scroll 21, the interior portion of the second seal element will be pushed downward during the downward movement of the floating seal member 30 relative to the fixed scroll 21. Consequently, both the first seal element 37 and the second seal element are installed correctly with their interior portions disposed along their desired directions. It is unnecessary for a worker to use a special tool to install the floating seal element 30 of the present invention. The present invention simplifies a scroll compressor's assembling procedure and reduces the difficulty of the assembling procedure. Thereby, a scroll compressor utilizing the present invention has a better product quality and a lower production cost.

Figure 3:
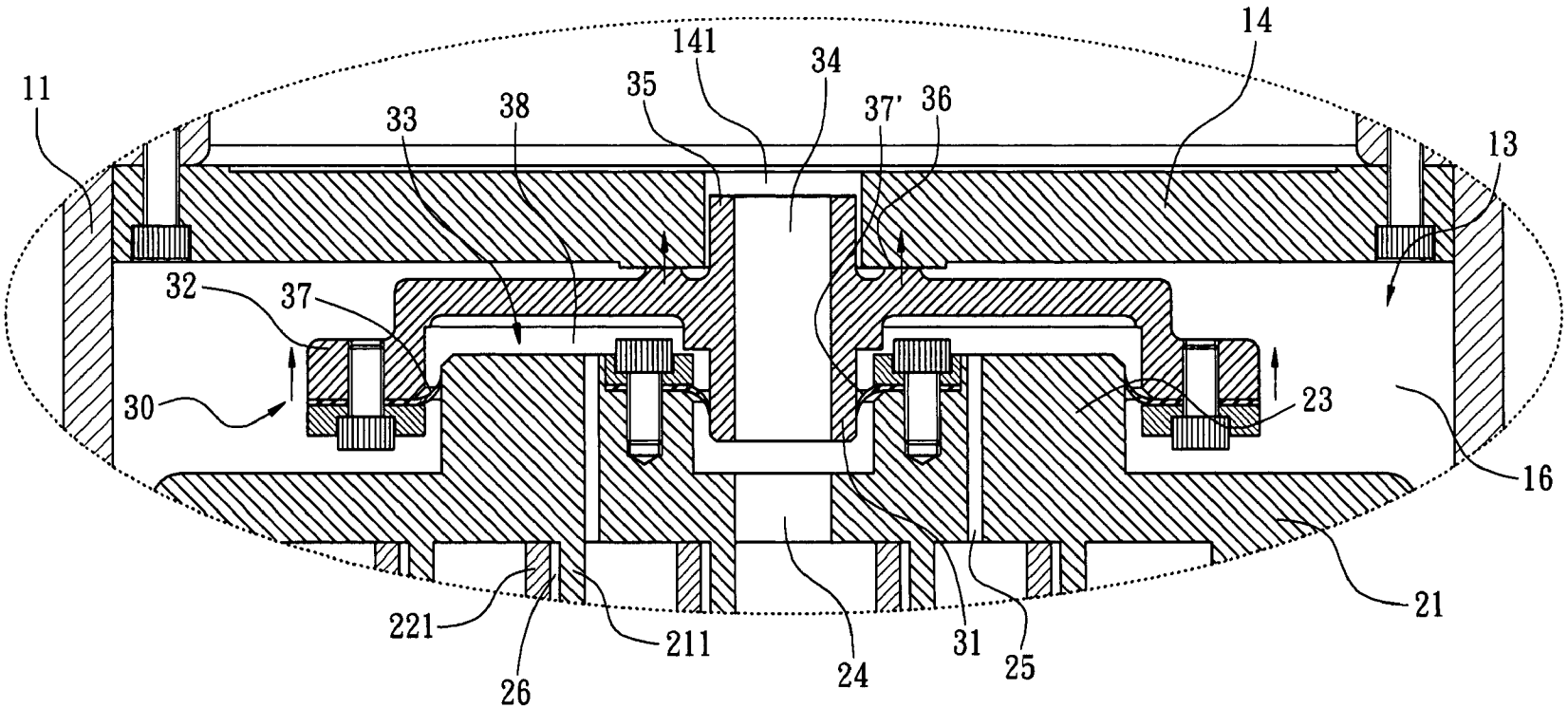
FIG. 3 is an enlarged view similar to FIG. 2, illustrating the operating condition of the present invention.

Referring to FIG. 3, by utilizing the aforementioned assembly, when the electric motor drives the orbiting scroll 22 to revolve, the low-pressure working fluid from the working fluid inlet of the second shell 12 will be sucked into the compression pockets 26 formed between the spiral wrap 211 of the fixed scroll 21 and the spiral wrap 221 of the orbiting scrolls 22. The revolution of the orbiting scroll 22 further moves the working fluid from the periphery of the scroll device 20 towards the center thereof. During compression the volume of the working fluid is gradually reduced while the pressure thereof gradually increases. The plurality of orifices 25 allows working fluid under an intermediate pressure to flow into the intermediate pressure room 38. The air pressure of the intermediate pressure room 38 pushed the floating seal member 30 upward against the bottom of the partition 14. The air pressure of the intermediate pressure room 38 further presses the fixed scroll 21 downward to closely attach the orbiting scroll 22, so as to achieve the sealing effect.

Figure 4:
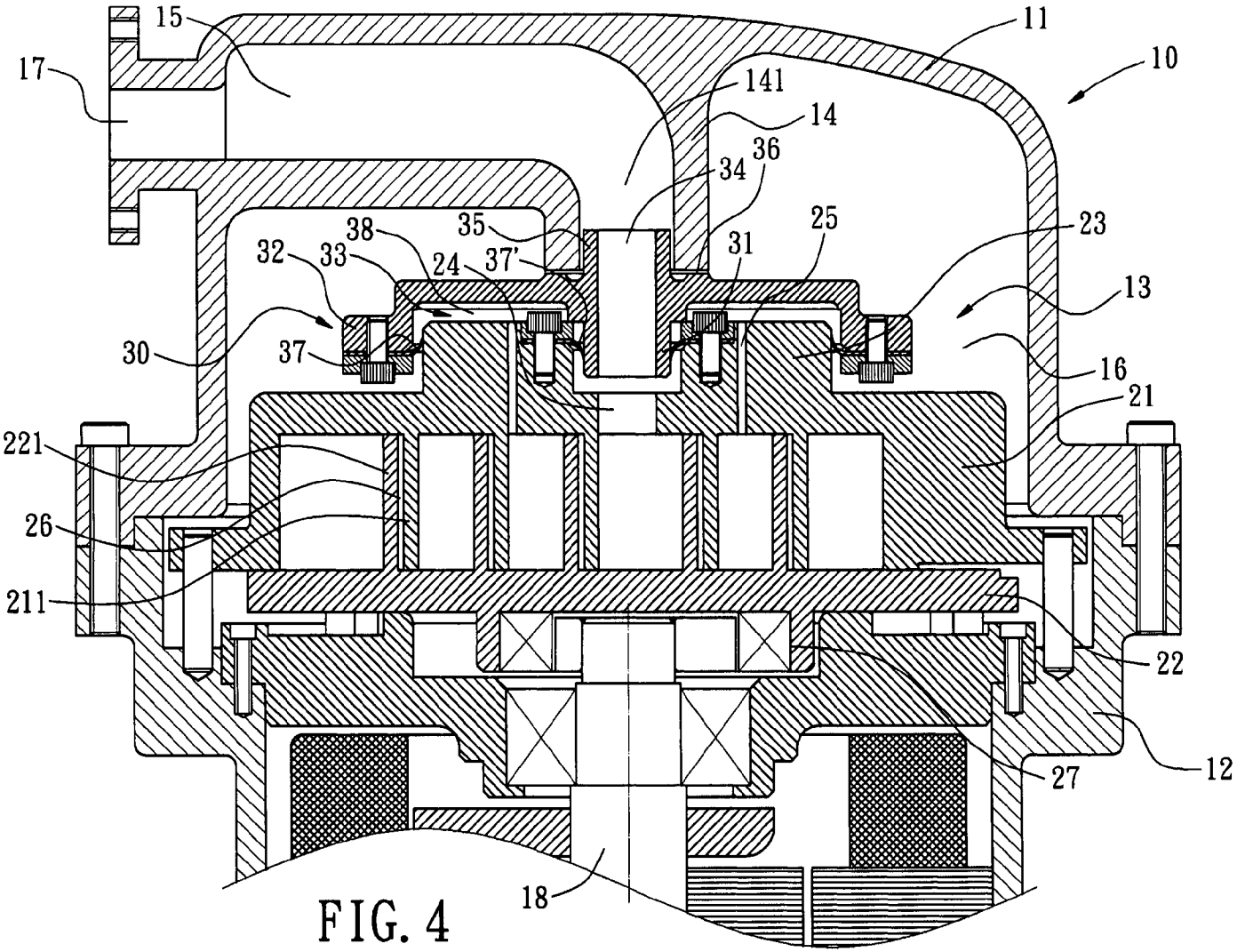
FIG. 4 is a partial cross sectional view of a scroll compressor utilizing a second embodiment of the present invention.

Referring to FIG. 4, a cross sectional view of a second embodiment of an axial sealing structure of a scroll compressor in accordance with the present invention is shown. The first shell 11 has a partition 14 extends from the receiving chamber 13 thereof. In the present embodiment, the partition 14 is a cylinder with a circular opening 141 formed at the center thereof. The opening 141 connects to the gas outlet 17 of the first shell 11. The inner diameter of the opening 141 corresponds with the exterior diameter of the top barrel 35 of the floating seal member 30. The contact surface 36 of the floating seal member 30 is opposite to the end surface of the cylindrical bottom of the partition 14.

In summary, the axial sealing structure of a scroll compressor as provided has at least three merits. First, two seal elements are respectively secured to the floating seal member and the fixed scroll. This arrangement is capable of both simplifying a scroll compressor's assembling procedure and reducing the difficulty of the assembling procedure. A scroll compressor utilizing the present invention has a better product quality and a lower production cost. Second, the axial sealing structure of a scroll compressor of the present invention has the floating seal member disposed between a partition and the top of the fixed scroll. An intermediate pressure room is formed between the floating seal member and the fixed scroll to force the fixed scroll to closely attach an orbiting scroll, so as to enhance the volume efficiency of the compressor. Third, the present invention guides the intermediate pressure working fluid into the intermediate pressure room to force the fixed scroll to move downward such that the axial force and biasing torque applied to the fixed scroll during compression are overcome. The lifetime of the scroll compressor is effectively extended.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A axial sealing structure of a scroll compressor, comprising:

a housing having a first shell and a second shell, the first shell having a receiving chamber inside which a partition is installed;

a scroll device including a fixed scroll and an orbiting scroll, a plurality of compression pockets formed between the fixed and orbiting scrolls, the fixed scroll having a protruding portion with a discharge passageway formed in the middle thereof, the protruding portion having a plurality of orifices bored therethrough;

a floating seal member with an inner ring and an outer ring extending from the bottom thereof, a central channel formed inside the inner ring, a recess portion defined between the inner ring and the outer ring, the floating seal member being disposed between the partition and the fixed scroll, the central channel opposite to the discharge passageway of the fixed scroll, the recess portion receiving the protruding portion of the fixed scroll, an pressure room defined between the recess portion of the floating seal member and the protruding portion of the fixed scroll;

at least one first seal element disposed between the inner periphery of the outer ring of the floating seal member and the outer wall of the protruding portion of the fixed scroll; and at least one second seal element disposed between the exterior periphery of the inner ring and the inner wall of the discharge passageway of the fixed scroll.

2. The axial sealing structure of a scroll compressor of claim 1, wherein the first seal element secured to the floating seal member and the second seal element secured to the protruding portion of the fixed scroll.

3. The axial sealing structure of a scroll compressor of claim 2, wherein the first seal element is secured to the bottom of the outer ring of the floating seal member by means of a plurality of screws, and the second seal element is secured to the end surface of the protruding portion of the fixed scroll by means of a plurality of screws.

4. The axial sealing structure of a scroll compressor of claim 1, wherein both the first seal element and the second seal element are a lip seal.

5. The axial sealing structure of a scroll compressor of claim 1, wherein the pressure room is an intermediate pressure room.

6. The axial sealing structure of a scroll compressor of claim 1, wherein the partition of the first housing is a disk with an opening opposite to the central channel of the floating seal member.

7. The axial sealing structure of a scroll compressor of claim 6, wherein the floating seal member further comprises a top barrel extending into the opening of the partition.

8. The axial sealing structure of a scroll compressor of claim 6, wherein the floating seal member further comprises a contact surface opposite to the bottom of the partition.

9. The axial sealing structure of a scroll compressor of claim 1, wherein the partition is a cylinder extends from the first shell, the cylinder comprising an opening opposite to the central channel of the floating seal member.

10. The axial sealing structure of a scroll compressor of claim 9, wherein the floating seal member further comprises a top barrel extending into the opening of the partition.

11. The axial sealing structure of a scroll compressor of claim 9, wherein the floating seal member further comprises a contact surface opposite to the end surface of the bottom of the partition.

* * * * *